US011124001B2

(12) United States Patent
Alvarez Tapia et al.

(10) Patent No.: US 11,124,001 B2
(45) Date of Patent: Sep. 21, 2021

(54) PRINTER CARRIAGE WITH SENSOR

(71) Applicant: HEWLETT-PACKARD DEVELOPMENT COMPANY, L.P., Spring, TX (US)

(72) Inventors: Jose Antonio Alvarez Tapia, Sant Cugat del Valles (ES); Chandrasekhar Nadimpalli, Sant Cugat del Valles (ES); Diego Lopez Ubieto, Sant Cugat del Valles (ES); Emilio Angulo Navarro, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/493,049

(22) PCT Filed: Jan. 18, 2018

(86) PCT No.: PCT/US2018/014263
§ 371 (c)(1),
(2) Date: Sep. 11, 2019

(87) PCT Pub. No.: WO2019/143339
PCT Pub. Date: Jul. 25, 2019

(65) Prior Publication Data

US 2021/0078343 A1 Mar. 18, 2021

(51) Int. Cl.
*B41J 25/304* (2006.01)

(52) U.S. Cl.
CPC ..... *B41J 25/304* (2013.01)

(58) Field of Classification Search
CPC ..... B41J 25/304
See application file for complete search history.

(56) References Cited

U.S. PATENT DOCUMENTS

| | | | | |
|---|---|---|---|---|
| 4,676,675 | A | 6/1987 | Suzuki et al. | |
| 4,881,840 | A | 11/1989 | Rendon et al. | |
| 5,360,276 | A * | 11/1994 | Petermann | B41J 25/308 400/55 |
| 6,203,220 | B1 | 3/2001 | Takenoshita et al. | |
| 7,281,872 | B2 * | 10/2007 | Studer | B41J 3/28 400/283 |
| 8,491,208 | B2 | 7/2013 | Kenji | |
| 2007/0039497 | A1 * | 2/2007 | Studer | B41K 1/56 101/405 |
| 2007/0098474 | A1 | 5/2007 | Studer et al. | |
| 2009/0284556 | A1 * | 11/2009 | Okazawa | B41J 25/308 347/8 |
| 2010/0079775 | A1 * | 4/2010 | Matoba | B41J 11/0095 358/1.9 |
| 2010/0220130 | A1 | 9/2010 | Bruno | |

(Continued)

FOREIGN PATENT DOCUMENTS

| | | |
|---|---|---|
| CN | 1155687 | 7/1997 |
| CN | 1233563 | 11/1999 |

(Continued)

*Primary Examiner* — Sharon Polk
(74) *Attorney, Agent, or Firm* — HP Inc. Patent Department

(57) ABSTRACT

A printer carriage comprises a sensor to be actuated when an actuation member coupled to the sensor contacts a raised portion in a printing target. A vertical position of the actuation member may be adjusted with respect to the printer carriage.

15 Claims, 13 Drawing Sheets

(56) References Cited

U.S. PATENT DOCUMENTS

| | | | | |
|---|---|---|---|---|
| 2013/0002761 | A1 | 1/2013 | Iwata | |
| 2013/0257956 | A1* | 10/2013 | de Jong | B41J 25/304 347/16 |
| 2015/0116395 | A1 | 4/2015 | Schelmbauer | |
| 2016/0368292 | A1 | 12/2016 | Kurosawa | |

FOREIGN PATENT DOCUMENTS

| | | | |
|---|---|---|---|
| EP | 1974931 | A1 | 10/2008 |
| JP | 2012091133 | A | 5/2012 |
| JP | 2013035184 | A | 2/2013 |

* cited by examiner

PRINTER CARRIAGE WITH SENSOR

BACKGROUND

Certain printers make use of a printing carriage during a printing process. For example, a printer may use a printer carriage to convey printheads above a printing target. In some instances, elements of the printing target, which may be a flexible or rigid printing medium or a build surface for depositing a material in a three-dimensional printer, may protrude towards the lower surface of the printer carriage. Such protruding elements may contact a portion of the printer carriage as the printer carriage moves over the printing medium. For example, a protruding element may contact the under surface of the printer carriage where a lower surface of the printheads may be located.

In some cases, contact between a part of the printer carriage, such as the printheads, and the printing target can cause smears on the printing surface or cause damage to the printer carriage. For example, damage may be done by contact with the printing medium causing cross-contamination between printheads of different types.

In some examples, a printing medium which contacts the printer carriage may cause a jam of the printer. In examples where the printing medium is flexible, collision between the printing medium and the printer carriage may cause a jam. While in examples where the printing medium is rigid, protruding portions may scratch or otherwise damage parts of the printing carriage, such as the printheads.

DETAILED DESCRIPTION

Certain examples described herein relate to a printer carriage comprising a sensor and an actuation member coupled to the sensor, wherein the actuation member is configured to actuate the sensor when an end of the actuation member contacts a printing medium. In some examples the vertical position of the actuation member may be adjusted.

Certain examples described herein relate to a printer carriage comprising a printhead and a first sensor assembly for sensing a raised portion of a printing medium and a second sensor assembly for sensing a raised portion of a printing medium. In some examples, the first sensor assembly and the second sensor assembly are mounted such that they are offset from one another in both the direction of movement of the printer carriage and are offset from one another in the direction of advance of the printing medium.

Certain examples may reduce damage to a print carriage by increasing reliability, sensitivity or accuracy of detecting a raised portion of the print medium.

Figure 1:
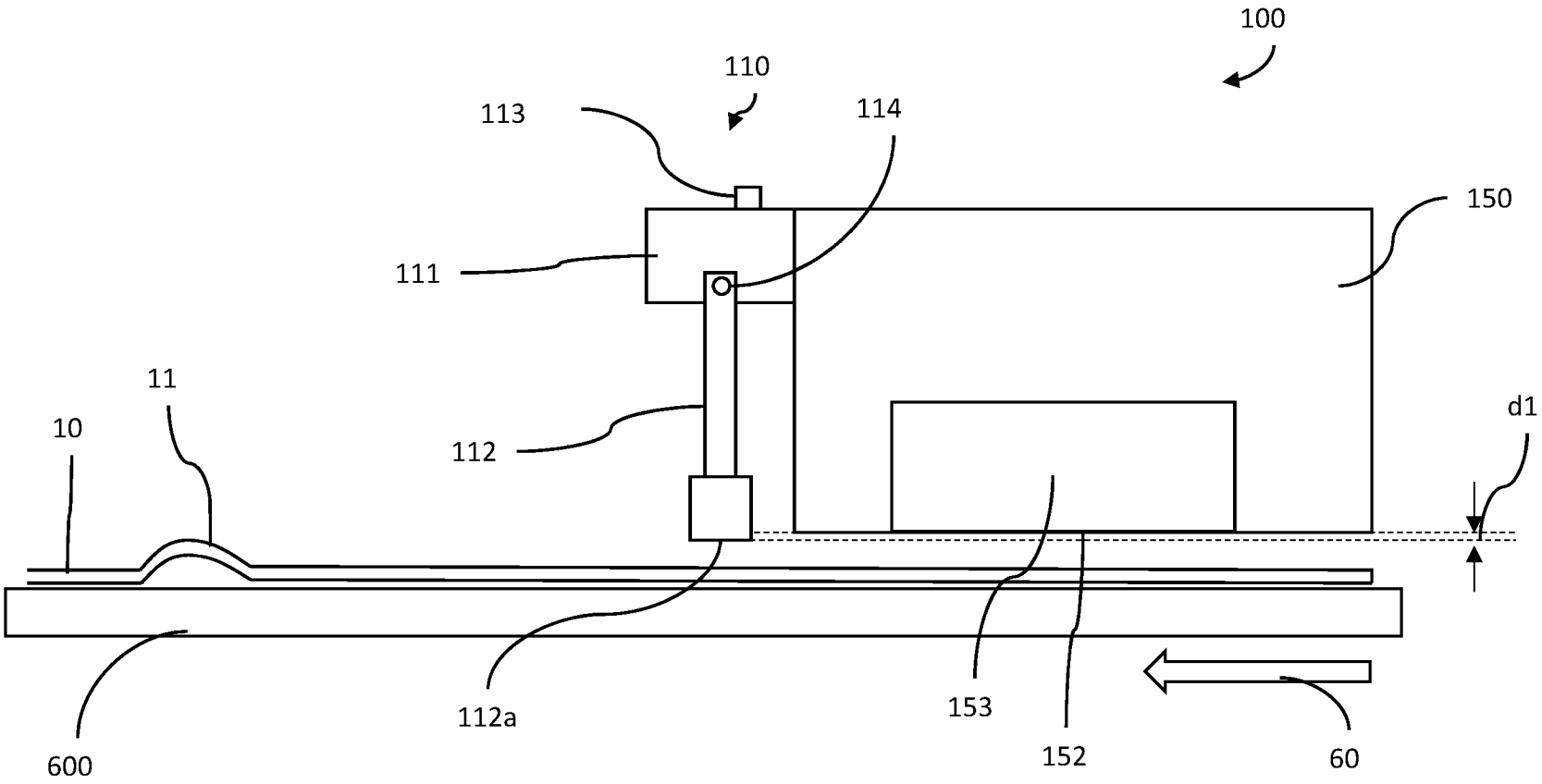
FIG. 1 shows a schematic side view of an example printer carriage comprising a sensor.

FIG. 1 shows a schematic side view of an example printer carriage 100 arranged above a printing medium 10 on a base surface 400. In this example, the printing medium 10 comprises a raised portion 11, which may for example be a defect in the printing medium, such as a fold or a raised edge or corner of the printing medium 10. The printer carriage 100 comprises an actuation member 112 which is coupled to a sensor 111 and is configured to actuate the sensor 111 when an end 112*a* of the actuation member 112 contacts the printing medium 10. Contact between the printing medium 10 and the actuation member 112, may occur, for example, when the actuation member 112 contacts a raised portion, such as raised portion 11, in the printing medium 10. The actuation member 112 is configured to actuate the sensor 111 when contact is made between the actuation member 112 and the raised portion 11. In the example of FIG. 1, the actuation member 112 and the sensor 111 are part of a sensor assembly 110. The distance between the lowest surface 152 of the printer carriage and a portion of the medium 10 which is not raised may be less than or equal to 0.3 mm, less than or equal to 1 mm, less than or equal to 1.5 mm, less than or equal to 2 mm, or less than or equal to 3 mm, for example around 0.2 mm, around 0.3 mm, 1.5 mm, around 1.8 mm, around 2 mm, around 2.5 mm, or around 3 mm. The lowest surface 152 may comprise a lowest surface of the printheads 153 and the distance between the printheads 153 and a portion of the medium 10 which is not raised may be less than or equal to 0.3 mm, less than or equal to 1 mm, less than or equal to 1.5 mm, less than or equal to 2 mm, or less than or equal to 3 mm, for example around 0.2 mm, around 0.3 mm, around 1.5 mm, around 1.8 mm, around 2 mm, around 2.5 mm, or around 3 mm.

The printer carriage 100 comprises a body portion 150 having a lowest surface 152. In some examples, such as those illustrated by the figures, the body portion 150 houses a printhead 153 and the lowest surface 152 may comprise a lowest surface of the printheads 153. In the example of FIG. 1, the distal end 112*a* of the actuation member is mounted at a vertical position d1 with respect to the lowest surface 152 of the printer carriage 100, such that when the actuation member 112 is in an equilibrium position its distal end 112*a* is at a distance d1 from the lowest surface 152. In this example, the actuation member 112 is configured to contact any portion 11 protruding to within a distance of d1 from the printer carriage lowest surface 152.

In some examples the vertical position d1 of the distal end 112*a* of the actuation member 112 is adjustable with respect to the printer carriage lowest surface 152. The sensor assembly 110 may comprise vertical adjustment system 113 allowing for adjustment of the vertical position d1. The vertical adjustment system 113 may comprise an adjustment screw and corresponded threaded portion, or any other suitable positioning system such as a cam. In the examples described herein, the vertical adjustment system 113 comprises a component located above the sensor 111. In other examples the vertical adjustment system 113 may be, for example, a height adjustment system located to a side of the sensor. In other examples, the height adjustment system may be configured to move the actuation member 112 with respect to the sensor, or move the sensor 111 and actuation member 112. For example, the height adjustment system may be configured to move the entirety of the sensor assembly 110 with respect to the body portion 150.

In some examples, such as those shown in the figures, the actuation member 112 is suspended vertically. In some examples, such as those shown in FIG. 1 and FIG. 2, the actuation member 112 is configured to rotate when contact is made between the distal end 112*a* of the actuation member 112 and a raised portion 11 of the printing medium 10. In the example shown in FIG. 1 and FIG. 2, the actuation member 112 is mounted to the sensor 111 via a pivot point 114. In some examples, the actuation member 112 may be configured to actuate the sensor 111 in a way other than by rotation. For example, the actuation member 112 may be configured to actuate the sensor 111 when horizontally displaced or vertically displaced from an equilibrium position.

Figure 2:
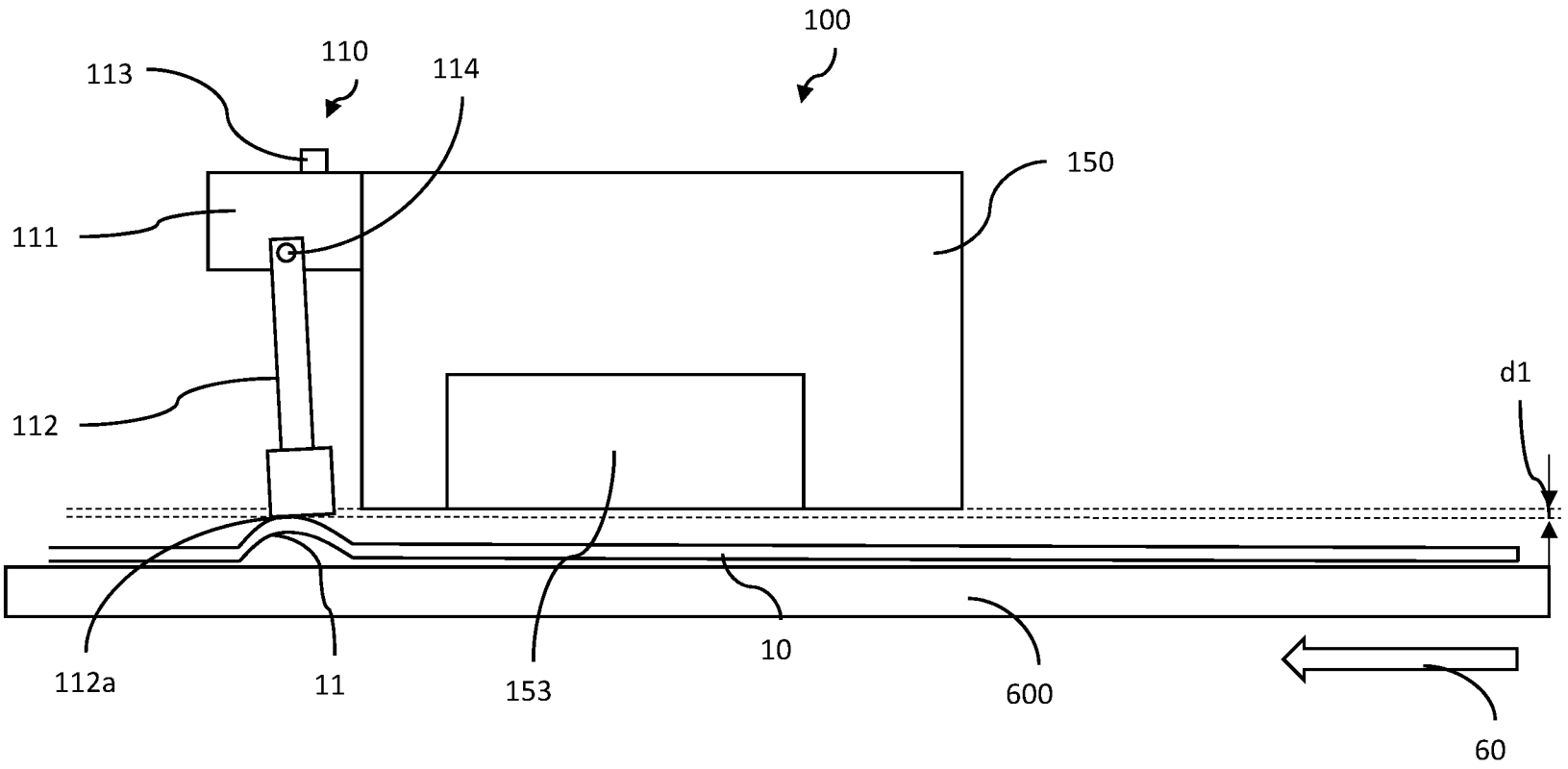
FIG. 2 shows a schematic side view of the example printer carriage of FIG. 1 after moving toward a raised portion in a printing medium.

With reference to FIG. 2, the printer carriage 100 is shown to have moved in the printer movement direction 60 towards the raised portion 11 in the printing medium 10. As mentioned above, the raised portion 11 in this example protrudes vertically to within the distance d1 between the equilibrium position of the distal end 112*a* of the actuation member 112. In FIG. 2, the actuation member 112 is shown to be in contact with raised portion 11. the actuation member 112 is rotated about the pivot point 114 due to the force exerted on the actuation member 112 by contact with the printing medium 10 as the printer carriage 100 moves along the carriage movement direction 60. In some examples, the actuation member may be an elongate member, while in other examples the actuation member may not be elongate.

In the example of FIG. 1 and FIG. 2 the actuation member 112 is configured to actuate the sensor 111 when caused to rotate by contact with the printing medium 10. In some examples the actuation member 112 may be configured to actuate the sensor 111 when the actuation member 112 rotates by a certain amount. For example, the actuation member 112 may be configured to actuate the sensor 111 when rotated by at least 7 degrees. In other examples the actuation member 112 may be configured to actuate the sensor 111 when rotated by a different amount. In some examples, the angle at which the sensor 111 is actuated is adjustable.

Vertically suspending the actuation member 112 and mounting the actuation member 112 rotatably by pivot point 114, as in the examples shown in the figures, allows the actuation member 112 to convert a small degree of vertical movement due to contact with the printing medium 10 into a relatively large angular movement.

The actuation member 112 may be configured to contact a raised portion 11 of the printing medium 10 when the raised portion 11 protrudes to within d1 from the lowest surface 152. The actuation member 112 may be configured to actuate the sensor 111 when the lowest vertical position of the distal end 112*a* of the actuation member 112 is at a distance which is smaller than d1 from the lowest surface 152. For example, in an equilibrium position, the lowest part of the actuation member 112 extends to a distance d1 which may be at least 0.1 mm, at least 0.2 mm, at least 0.3 mm, at least 0.4 mm, at least 0.5 mm, below the lowest surface 152 of the printer carriage 100. In some examples the lowest part of the actuation member 112 extends to a distance d1 of between 0.2 and 0.3 mm below the lowest surface 152 of the printer carriage. The actuation member 112 may be configured to actuate the sensor 111 when the lowest part of the distal end 112*a* of the actuation member 112 is moved by contact with the raised portion 11 to within a distance, which may be around 0.1 mm, 0.2 mm or 0.3 mm, below the lowest surface 152. The sensor assembly then may provide a minimum distance from the lowest surface 152 to which any portion of the printing medium 10 may approach before the sensor 111 is actuated; and the minimum distance may be less than the distance d1 at which the actuation member 112 contacts a raised portion 11.

In examples where the actuation member 112 is configured to actuate the sensor upon being rotated, the length of the sensor and the degree of rotation which causes actuation may be chosen to provide a defined distance a raised portion 11 may protrude before a sensor 111 contacting the raised portion 11 is actuated. The actuation member 112 of some examples may be set at such a height that it can avoid damage to printheads 153 through contact with a raised portion 11 while extending a short distance d1 below the lowest surface 152 of the printer carriage 100. Positioning the actuation member a short distance d1 below the lowest surface 152 may avoid causing contact with the printing medium 10 where there is not a significant risk of a collision with the printheads. Positioning the actuation member a short distance d1 below the lowest surface 152 may avoid for example, causing smudging on the printing medium 10. The actuation member 112 may be set at such a height as to be actuated where there is a risk of collision between the medium 10 and the printheads 153.

The sensor 111 may be coupled to a controller (not shown in FIG. 1 or FIG. 2) and the controller may be configured to stop movement of the printer carriage 100 when the sensor 112 is actuated by the actuation member 112. The controller 550 may comprise, for example, a printed circuit board comprising a processing system, such as a Central Processing Unit (CPU) and may comprise a microcontroller. The printer 500 may comprise circuitry (not shown) coupling the controller 550 to the sensor 111 and, for example, to a braking system of the carriage or a system configured to drive the printing medium through the printer. The controller 550 may be coupled to a system for driving the printer carriage. The controller 550 may run firmware, embodied as computer instructions stored in a non-transitory storage, such as non-volatile memory or hard drive.

Stopping the movement of the carriage 100 when the actuation member 112 actuates the sensor 111 may prevent contact between the printing medium 100 and a part of the printer carriage 100, for example the printheads 153. Preventing contact between the printheads 153 and the printing medium 10, prevents damage which may be done to the printheads 153 or the printing medium 10 by such contact.

Figure 3:
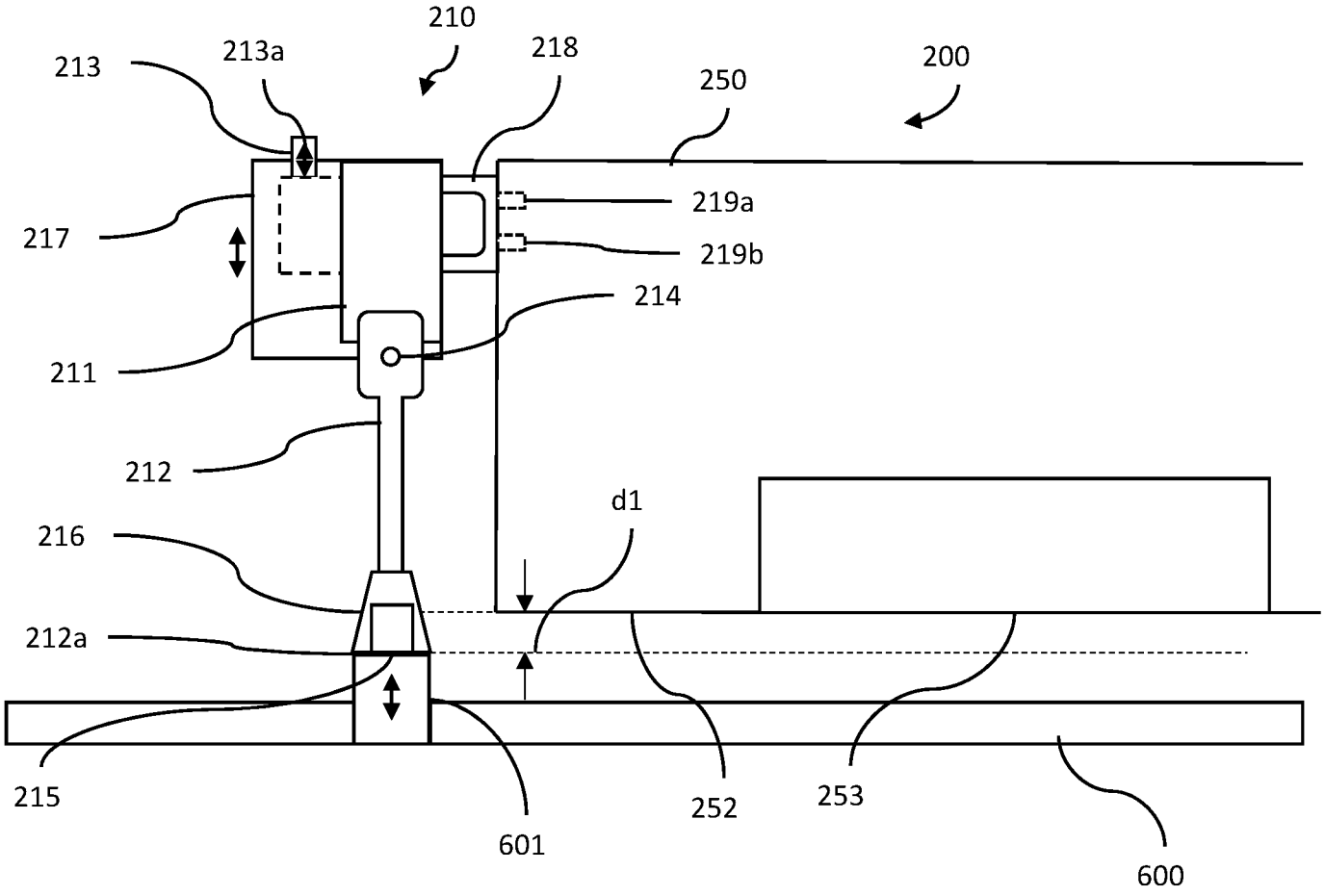
FIG. 3 shows a schematic side view of an example sensor assembly mounted to a printer carriage.

FIG. 3 shows a schematic view of an example printer carriage 200 and sensor assembly 210. The sensor assembly 210 shown in FIG. 3 comprises actuation member 212 and sensor 211 which may have any of the features described with reference to the actuation member 212 and sensor 211 of FIG. 1 and FIG. 2. FIG. 3 shows the actuation member 212 comprising a material 215 at its distal end 212*a*. The material 215 is a high-friction material, and the material 215 and printing medium 10 may be chosen such that a static coefficient of friction between the material 215 and the printing medium 10 is at least 0.3. The material 215 may, for example, be rubber and may have a Shore A hardness of 70. The printing medium may, for example, be paper, cardboard, plastic, metal, glass or tile. Where the printing medium is metal, the metal may be aluminium. Where the printing medium is tile, the tile may be enameled tile. The material 215 acts to provide a friction force between the distal end 212*a* of the actuation member 212 and any raised portion of the printing medium 10. As such, the material 215 may allow the actuation member 212 to grip the printing medium and transfer movement of the printer carriage 200 into rotation of the actuation member 212 when the printer carriage 200 is in motion and a raised portion 11 in the printing medium 10 is encountered. The material 215 may be held in a housing 216 and the housing 216 may be configured such that it shields the material 215 from lateral impact by a raised portion 11 due to movement of the carriage 200.

The height of the actuation member 212 may, for example, be around 100 mm, or around 110 mm, or around 120 mm, or around 109.2 mm. The actuation member 212 may comprise a narrow portion at its centre with a broad portion at an end proximal to the sensor. The narrow portion may, for example, have a width of around 10 mm, or around 8 mm, or around 6 mm, or around 4 mm, or around 5.5 mm. The broad portion may, for example, have a width of around 25 mm, or around 20 mm, or around 15 mm. The distance from the centre of the pivot point 214 and the top of the actuation member may be, for example, around 5 mm, or around 10 mm, or around 11.5 mm. The housing 216 may have a height of, for example, around 20 mm, or around 40 mm or around 31.5 mm. The housing 216 may flare outwards towards the distal end 212*a*. The housing may flare out towards the distal end 212*a* such that an angle between the foremost side of the housing and the rearmost side of the housing is around 15 degrees, or around 20 degrees, or around 30 degrees. The material 215 may extend vertically to a height below the lowest part of the housing 216 of, for example, around 1 mm, or around 0.8 mm, or around 0.6 mm, or around 0.5 mm. The distance from the foremost side of the housing to the rearmost side of the housing may be around 20 mm, or around 15 mm, or around 10 mm, or around 18.5 mm at the distal end 112*a*. The actuation member may also flare out when viewed from the direction of carriage movement 60. The housing 216 may be substantially frustoconical in shape. The material 215 may be substantially frustoconical in shape. An upstream side of the housing and a downstream side of the housing may be at an angle of around 30 degrees, or around 40 degrees, or around 50 degrees, or around 60 degrees. An upstream side of the material 215 may be at the same angle to a downstream side of the material 215 as the upstream and downstream sides of the housing 216 are to each other. A distal from the upstream end of the material 215 to the downstream end of the material 215 at the distal end 212*a* may be, for example, around 30 mm, or around 35 mm, or around 40 mm, or may be 35.9 mm. The distance from the foremost side of the material 215 to the rearmost side of the material may be around 10 mm, or around 15 mm, or around 20 mm, or around 14 mm at the distal end 112*a*.

The housing 216 may comprise a plastics material. The actuation member 212 may be formed to have low inertia. This may increase the sensitivity to raised portions of the printing medium that are flexible and may be deformed downwards by the actuation member itself. The actuation member may comprise a rigid material to allow rotation of the member 212 without deformation of the member 212 affecting the reliability of measurements of rotation produced in the member. The actuation member may in some examples comprise aluminium and in some examples may comprise a plastics material. In some examples the actuation member 212 is elongate in form, this may contribute to reducing the force exerted on the distal end 212*a* to provide a rotation for causing actuation of the sensor. The combination of material 215, and the mass, form and mounting of the actuation member 212 may contribute to allowing the actuation member 212 to be rotated without slipping over the printing medium 10, and, for example, without smudging printing fluid. The combination of material 215 and the mass, form and mounting of the actuation member 212 may contribute to allowing detection of raised portions in a medium which is at least one of soft, flexible, elastic, wet, smooth, and may contribute to allowing the actuation member 212 to be rotated without damaging the printing medium 10.

The sensor in any of the examples described here may be a commercially available sensor and may in some examples be an electronic position switch, such as an Eaton™ LSE-11 electronic position switch.

The sensor assembly 210 shown in FIG. 3 comprises a bracket 217 and the sensor 211 and the actuation member 212 are mounted to the bracket 217. In this example, the sensor 211 and the actuation member 212 are rigidly mounted to the bracket 217, such that their position with respect to the bracket 217 is fixed. The sensor assembly 210 comprises a beam 218 and the bracket 217 is movably attached to the beam 218. In this example, the sensor assembly 210 comprises height adjustment system 213 which provides for vertical movement of the bracket 217, with the sensor 211 and the actuation member 212 mounted thereto, with respect to the beam 218. The height adjustment system in some examples may comprise an adjustment screw which may be loosened or tightened to change the vertical position of the bracket 217 with respect to the beam 218, as indicated by arrow 213*a*.

In some examples the sensor assembly 210 is detachable from the printer carriage. In the example of FIG. 3 the beam 218 comprises locating pins 219*a* and 219*b* which are received in locating slots (not shown) in the body portion 250 of the printer carriage 200. The locating pins 219*a*, 219*b* when received in the locating slots act to vertically position the beam 218 with respect to the printer carriage 200. The beam 218 or the body portion 250 may comprise a system for removably attaching the sensor assembly 210 to the body portion 250. This may allow replacement when the sensor is damaged. In some examples, the sensor assembly 210 may not be detachable from the printer carriage. In some examples, the sensor 211 and the actuation member 212 may be separately detachable from the printer carriage 200, or the bracket 217 may be detachable from the beam 218.

As mentioned above, in some examples the vertical position d1 of the distal end of the actuation member with respect to the lowest surface of the printer carriage may be adjusted. In the example of FIG. 3, the base surface 600 of the printer comprises a reference member 601 which assists with setting or verifying the vertical position of the actuation member 212. The reference member 601 may be configured to extend to a distance which may be adjusted above the base surface 600. When the reference member 601 is located beneath the actuation member 212 the reference member 601 may be used to vertically position the actuation member 212. In the example of FIG. 3, the distal end 212*a* of the actuation member 212 is set to a height d1 using the reference member 601: The height of the reference member 601 is set to a height such that it is a distance d1 below the lowest surface 252 of the printer carriage 200. The height adjustment system 213 is then used to adjust the height of the bracket 217 with respect to the beam 218, until the distal end 212*a* of the actuation member 212 abuts the upper surface of the reference member 601.

In some examples, the actuation member 212 may be detachable from the printer carriage 200 and may be replaceable. The actuation member 212 in some examples may be replaced when damaged by contact with a portion of the printing medium 10.

Figure 4:
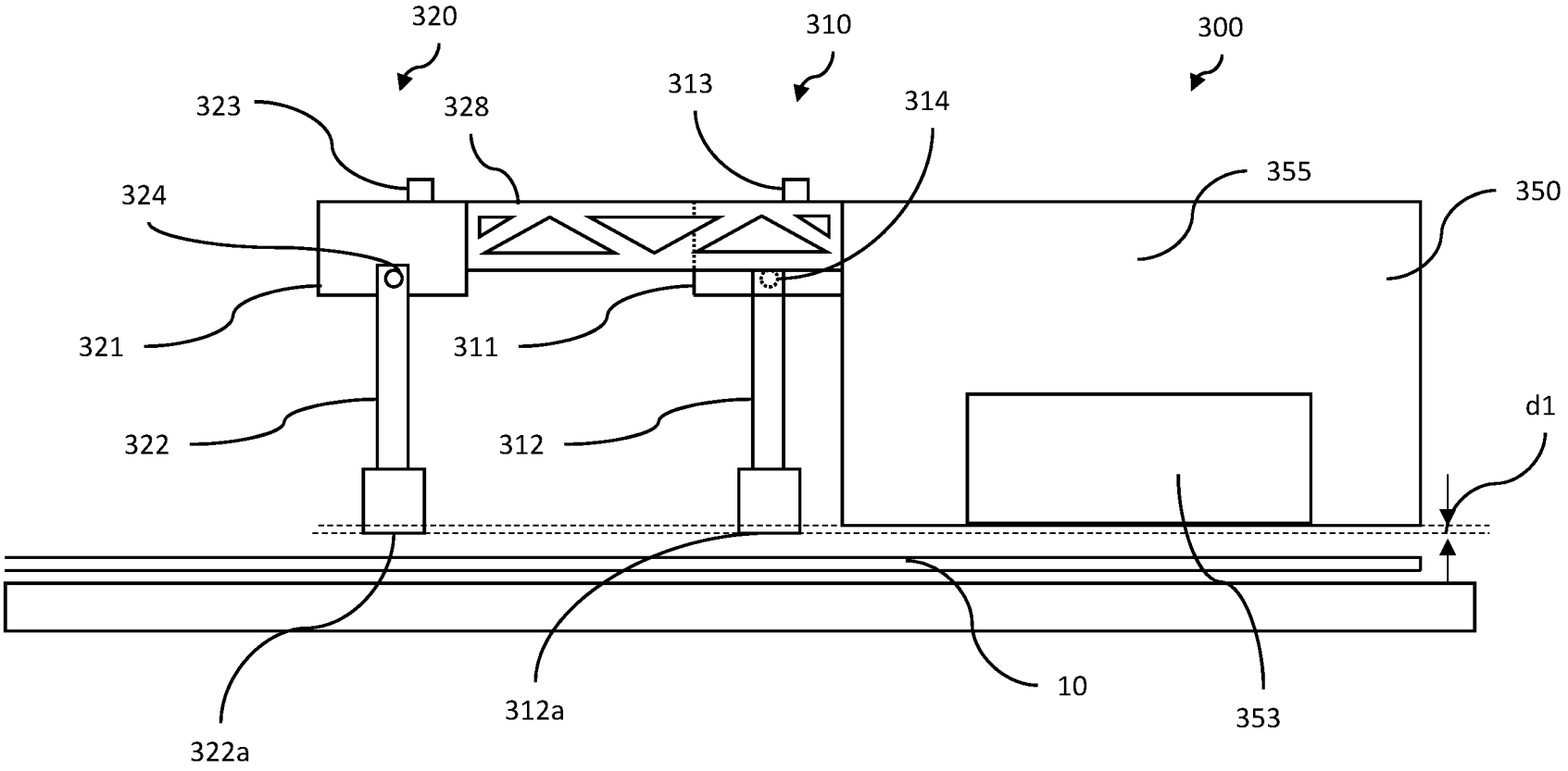
FIG. 4 shows a schematic side view of an example printer carriage comprising two sensor assemblies.

FIG. 4 shows an example printer carriage 300 comprising a first sensor assembly 310 and further comprising a second sensor assembly 320. The first sensor assembly 310 and the second sensor assembly 320 may comprise any of the features described above for other examples of the sensor assembly. The second sensor assembly 320 comprises a second actuation member 322, having a distal end 322*a* for contacting a raised portion (not shown in FIG. 4) of the printing medium 10 when a raised portion protrudes to within a distance d1 from the lower surface of the carriage 300. The height of the second actuation member 312 is adjustable via height adjustment system 323, which may comprise any suitable height adjustment system as described for other examples of the sensor assembly. The second actuation member 312 is suspended vertically from a pivot point 324 and, in this example, is elongate in form.

In this example, the second actuation member 322 is coupled to a second sensor 321 and configured to actuate the second sensor 321 when the distal end 322*a* senses a raised portion of the printing medium 10. In some examples, the printer carriage may not comprise a second sensor 321 and the second actuation member 322 may be coupled to the first sensor 311 such that the first sensor 311 is configured to be actuated when one of the first actuation member 312 and the second actuation member 322 contacts the printing medium 10.

In the example shown in FIG. 4, the second sensor assembly 320 comprises a second beam 328 to which the second sensor 321 and second actuation member 322 are mounted such that the second actuation member 322 is attached to the printing carriage 300 in a cantilevered arrangement. In other examples, the second sensor assembly may be attached at a different distance from the foremost edge of the printer carriage. For example, the second sensor assembly may be mounted substantially at the foremost edge of the carriage any may be mounted in the same position with respect to the direction of movement of the carriage as the first sensor assembly. In some examples, the carriage may comprise a braking system which allows the carriage to be stopped before contact can be made between a raised portion sensed by the second sensor assembly and the printheads.

In the example shown in FIG. 4, a downstream end 355 of an example printer carriage 300 is seen. In this example, the second sensor assembly 320 is located towards the downstream end 355 of the printer carriage 300 while the first sensor assembly 310 is located towards an upstream end 354 (FIG. 6) of the printer carriage 300. The first sensor assembly 310 is therefore shown in FIG. 4 behind the second sensor assembly 320. In this example, the second actuation member 322 is positioned at the same vertical height d1 as the first actuation member 312 though in some examples the first actuation member 312 and the second actuation member 322 may be mounted at different vertical heights, for example the first sensor assembly 310 and the second sensor assembly 320 may be configured to sense raised portions of different heights. In some examples the first sensor assembly 310 and the second sensor assembly 320 may be configured to sense raised portions towards the upstream 354 and downstream 355 ends respectively of the printer carriage 300. Example arrangements of the first sensor assembly 310 and the second sensor assembly 320 will be discussed below in further detail with reference to FIGS. 6 to 13.

Figure 5:
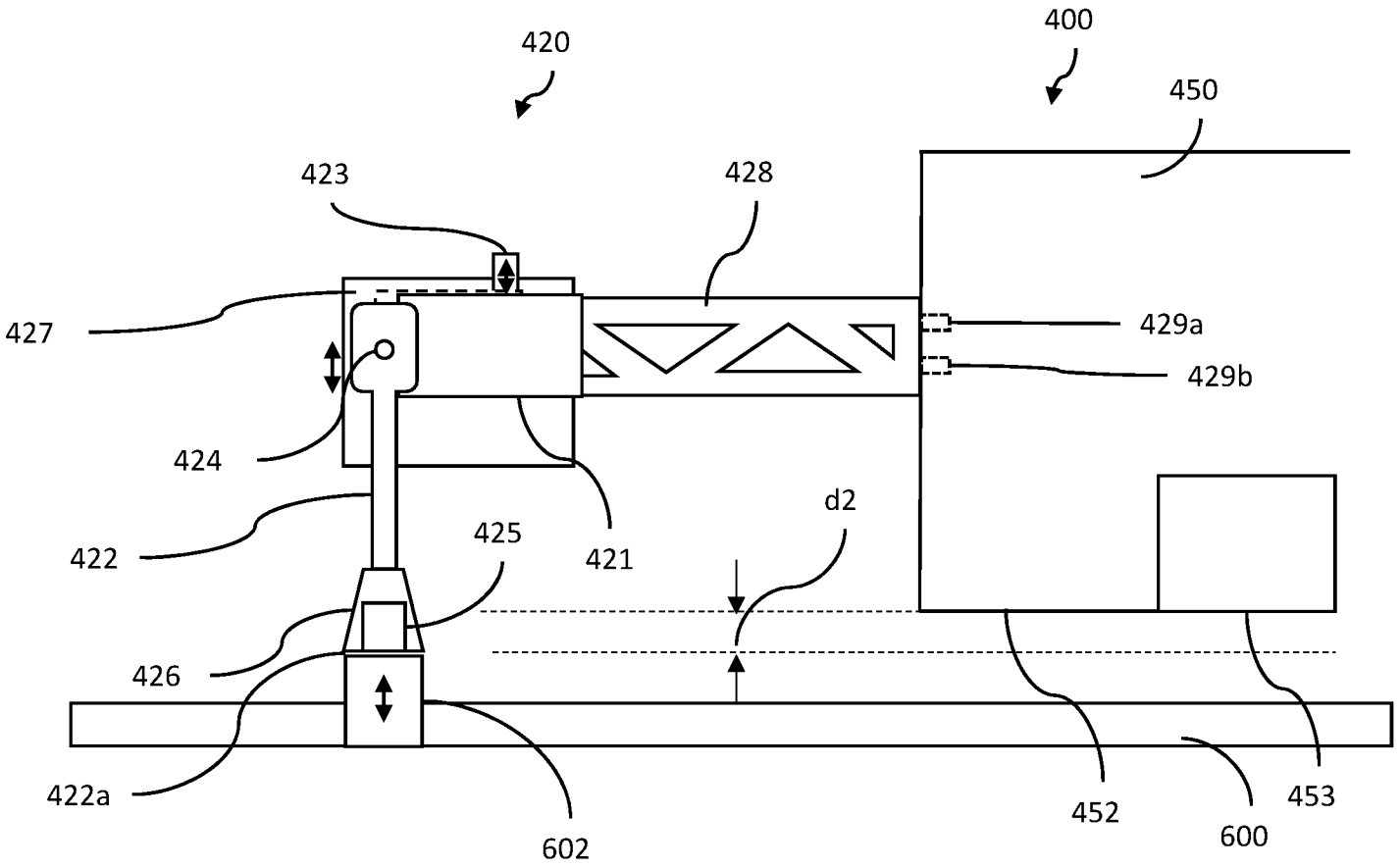
FIG. 5 shows a schematic side view of an example sensor assembly mounted to a printer carriage.

FIG. 5 shows an example second sensor assembly 420 in a schematic side view from the downstream end of an example printer carriage 400 with respect to the medium advance direction. In the example of FIG. 5, the second sensor assembly 420 comprises a second actuation member 422 having a distal end 422*a*. The printer carriage 400 may comprise another sensor assembly, such the first sensor assembly (not shown in FIG. 5). The base surface 600 comprises a second reference member 602 which may be used to assist vertical positioning of the second actuation member 422. In this example the second reference member 602 can be used to position the distal end 422*a* of the second actuation member 422 when in an equilibrium position to a vertical position at a distance d2 from the lowest surface 452 of the printer carriage 400. d2 may be the same as or different to the vertical position d1 of the first actuation member 412 in other examples. In examples where the printer carriage 400 comprises more than one actuation member, for example a first sensor assembly and a second sensor assembly, the base surface 600 may comprise corresponding reference members, for example first reference member 601 and second reference member 602. In some examples, a reference member, such as first reference member 601, may be used to assist positioning of more than one actuation member, for example the first reference member 601 may be used to position both a first actuation member and a second actuation member.

The vertical positioning of the actuation member or actuation members may be set during subassembly of a printer comprising the printer carriage 100 or may be set after subassembly. In some examples, the reference member or reference members may be used to verify positioning of an actuation member where the position of the actuation member or actuation members has been set during subassembly of the printer. In some examples the reference member or reference members may be used to verify the vertical position of the printing carriage.

As shown in FIG. 5, the second sensor 421 and second actuation member 421 are mounted to a second bracket 427 which is movably attached to the second beam 428. The height of the second bracket 427 may be adjusted, via second height adjustment system 423, to adjust the height of the second actuation member 422. In the example of FIG. 5 the height of the second bracket 427 is adjustable with respect to the second beam 428 as described for the bracket 217 with respect to the beam 218 with reference to FIG. 3.

With reference to FIG. 5, the second sensor 421 is mounted in a horizontal orientation. The second beam 428 is mounted to the body portion 450 at a vertical position which is substantially at the vertical position of the second pivot point 414. This vertical position at which the second beam 428 is mounted to the body portion 450 can be seen in FIG. 5 to be lower than if the sensor 421 were mounted vertically to maintain the same height of pivot point 414. Mounting the second sensor 421 horizontally may provide a more compact arrangement when the second sensor assembly 420 comprises a cantilevered arrangement. In other examples, the second sensor may be mounted in a different orientation, for example vertically as shown in examples of the first sensor assembly.

FIG. 5 shows the second sensor assembly 420 comprising second locating pins 429*a* and 429*b* which are received in corresponding locating slots (not shown). The second locating pins 429*a* and 429*b* are used to locate the second sensor assembly 420 and to provide a detachable arrangement between the second sensor assembly 420 and the body portion 450. The second sensor assembly 420 and the first sensor assembly (not shown in FIG. 5) may comprise further elements (not shown) for providing a detachable connection between each sensor assembly and the body portion 450. For example, a screw with corresponding threaded portion may be provided attaching each sensor assembly to the body portion. Any elements described for the detachable connection of other described example sensor assemblies to a body portion of a printer carriage may also be used for attaching the second sensor assembly 420 to the body portion 450. As described for the sensor assembly 310 with reference to FIG. 3, the second sensor assembly 420 may in some examples not be detachable from the printer carriage 400 and the components of the second sensor assembly 420 may be detachable from one another and from the printer carriage 400.

Figure 6:
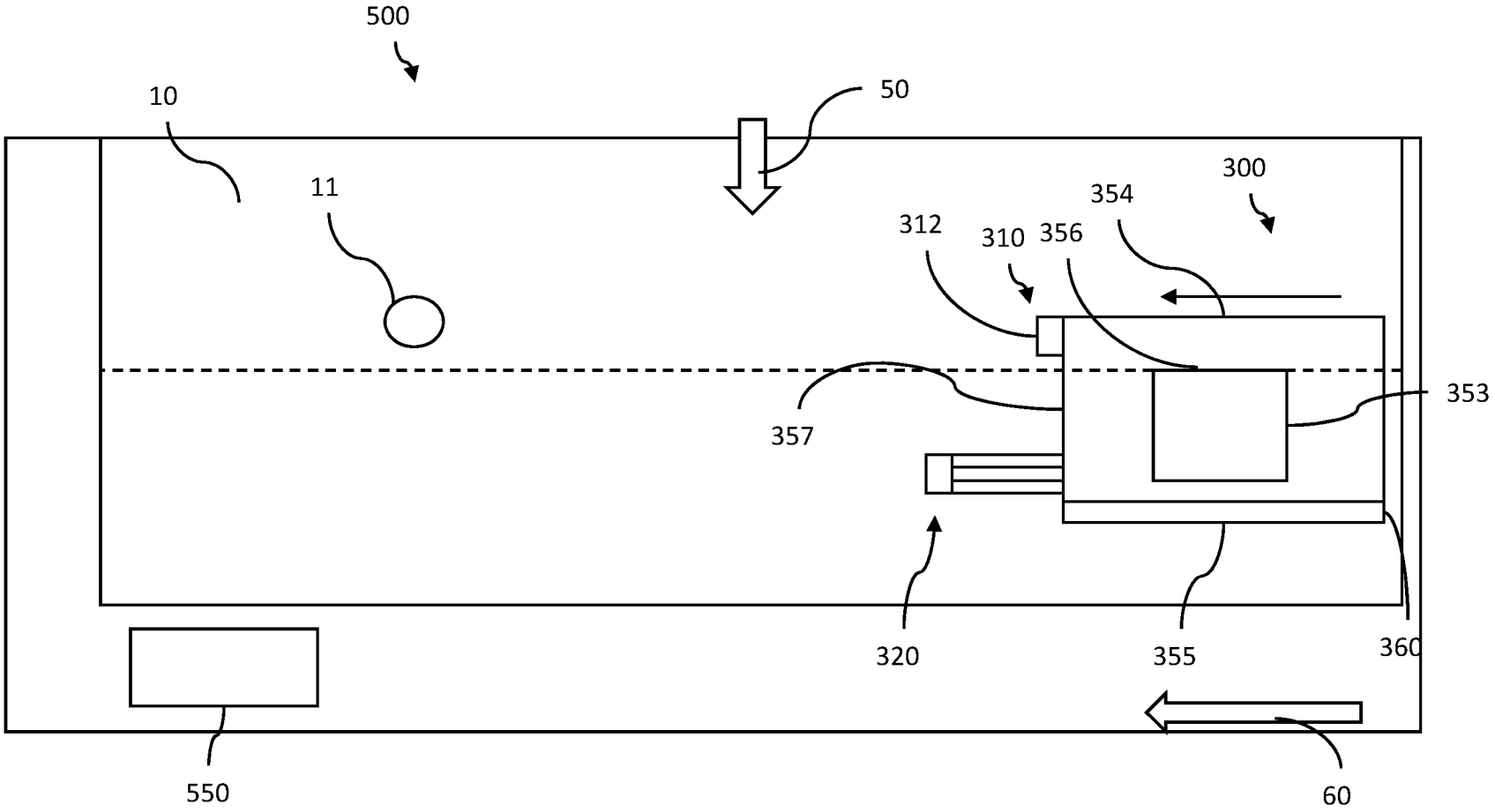
FIGS. 6 to 13 show a schematic top down view of an example printer comprising an example printer carriage at various different positions with respect to a raised portion of a print medium.

FIG. 6 shows a schematic plan-view representation of an example printer 500 comprising a printer carriage 300 according to certain previous examples, having a first sensor assembly 310 and a second sensor assembly 320. In this example, a printing medium 10 advances into the printer 500 in a printing medium advance direction 50. The printer carriage 300 is shown in FIG. 6 in a starting position in the printer carriage movement direction 60. The printing carriage 300 may be mounted on one or more rails (not shown) allowing movement of the printing carriage in the printing carriage movement direction 60 and, for example, allowing the printing carriage 300 to convey the printheads 353 over the printing medium 10 for printing on the printing on the printing medium 10. In some examples the printer 500 may be a commercially available printer and in some examples the first sensor assembly 310 and the second sensor assembly 320 may be retrofitted to the printer carriage 300.

FIG. 6 shows the printheads 353 having an upstream end 356 represented by a dotted line in the carriage movement direction 60. In this example, a first sensor assembly 310 is located towards an upstream end 354 of the printer carriage 300 in the printing medium advance direction 50 and the first sensor assembly 310 is located at a foremost end 357 of the printer carriage 300 in the direction of carriage movement 60. The second sensor assembly 320 is mounted towards a downstream end 355 of the printer carriage 300, in cantilever, and is located downstream of the upstream end 356 of the printheads 353. The second sensor assembly 320 is located spaced from the foremost end 357 of the printer carriage 300.

With reference to FIG. 6, FIG. 7, FIG. 8 and FIG. 9, the printing medium 10 comprises first raised portion 11. As mentioned above, the first raised portion 11 may be, for example, a defect in the printing medium 10 or a raised edge of the printing medium 10. The first raised portion 11 may be a raised portion which is present in the printing medium 10 before the printing medium 10 is fed into the printer 500 or may in some examples be a defect which is caused by the feeding of the medium 10 into the printer, for example a defect caused by a roller of the printer 500. The first actuation member 312 is set at a vertical position d1 such that it is configured to sense the raised portion 11 by making contact therewith when the actuation member is positioned over the first raised portion 11.

Figure 7:
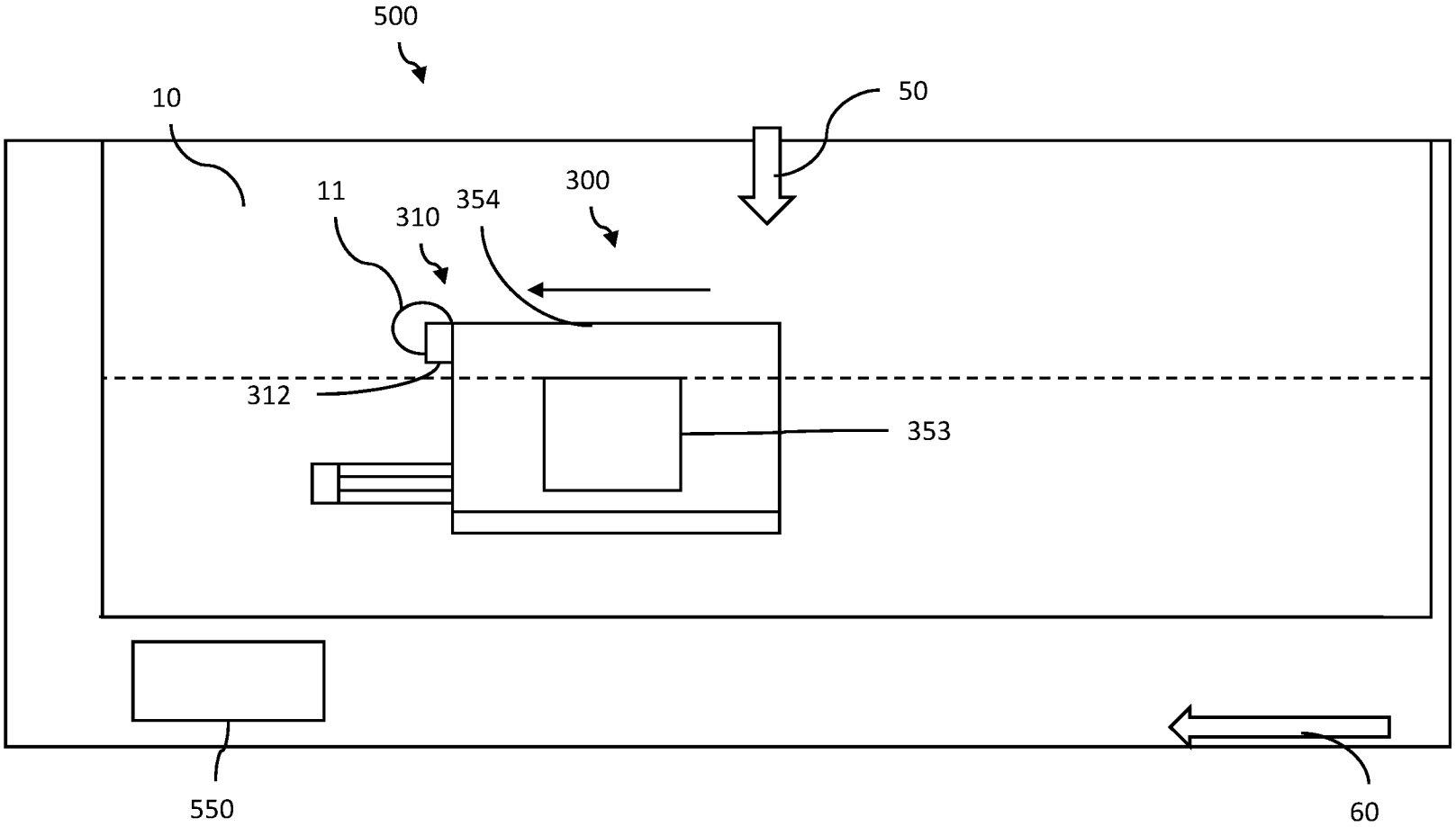

FIG. 7 shows the printer carriage 300 moved in the printing carriage movement direction 60 such that the first actuation member 312 is positioned over the first raised portion 11 and the distal end 312*a* of the first actuation member 312 is in contact with the first raised portion 11. The first actuation member 312 in this example is caused to rotate by the contact between its distal end 312*a* and the first raised portion 11 as the printing carriage 300 moves in direction 60. FIG. 7 shows the printing carriage 300 in a position where the first actuation member 312 actuates the first sensor 311.

In some examples, the printer 500 comprises a controller 550 which is coupled to the first sensor assembly 310 and the second actuation assembly 320. Where the printer carriage comprises a first sensor 311 and a second sensor 321 the controller 550 may be coupled to the first sensor 311 and the second sensor 321. In examples comprising a different number of sensors, for example one sensor configured to be actuated by the first and second actuation members, the controller 550 may be coupled to each sensor. The controller 550 may be configured to stop the printer carriage 300 when it receives an actuation signal from one of the sensors. In the example shown in FIGS. 6 to 9, the printer 500 comprises a controller 550 configured to receive a signal from the first sensor assembly 310 and the second sensor assembly 320.

FIG. 7 shows the first sensor assembly 310 sensing a first raised portion 11. The first actuation member 312 is rotated by the raised portion 11 to actuate the first sensor 311. The first sensor 311 sends an actuation signal to the controller 550. In some examples the controller stops the carriage on receipt of an actuation signal from one of the sensor assemblies. The controller 550 may also be configured to stop the advance in the direction 50 of the printing medium 10 upon receipt of an actuation signal from one of the sensors.

Figure 8:
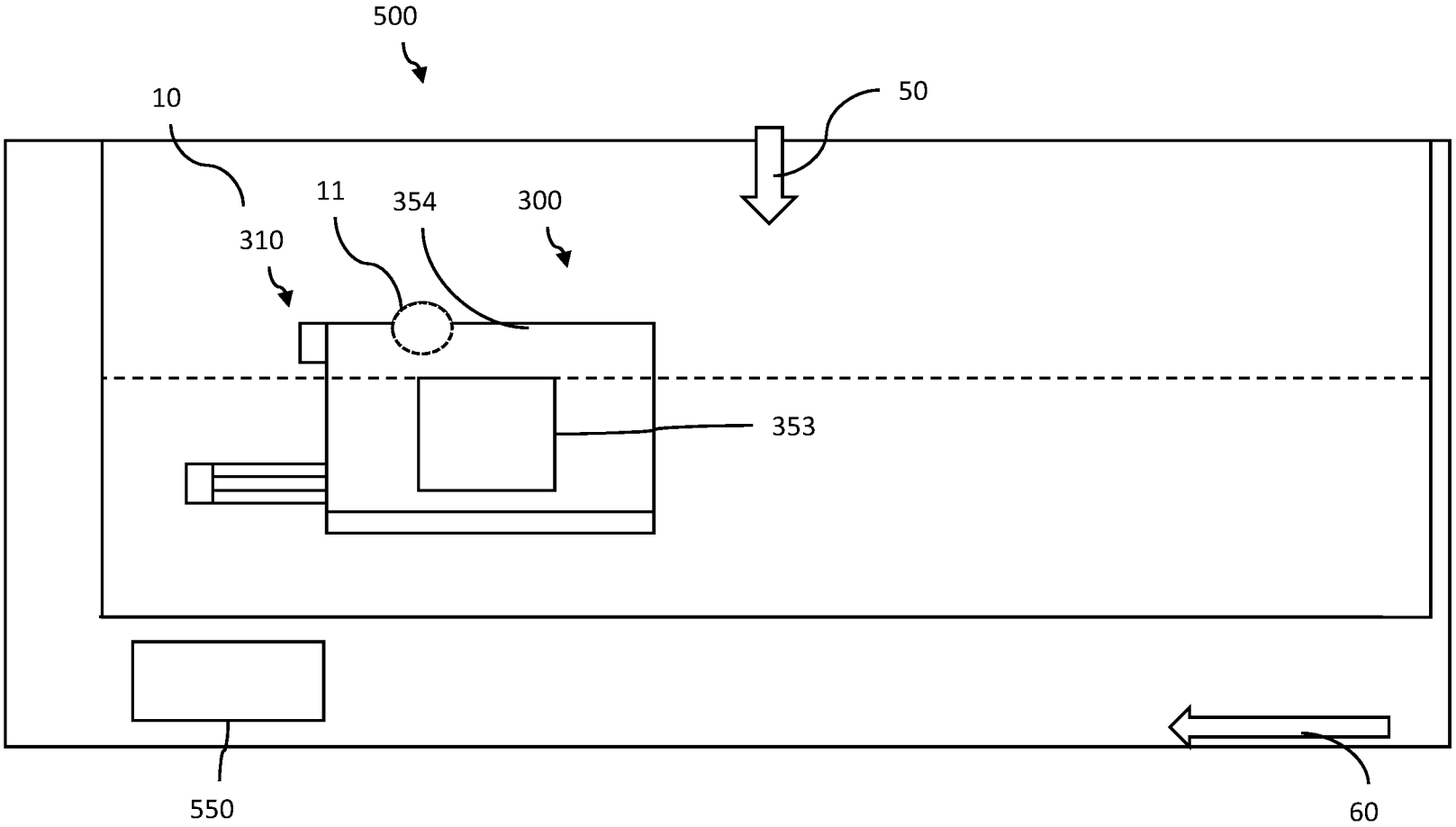

FIG. 8 shows the printer carriage 300 at the point at which the printer carriage has been stopped by the controller 550. The actuation signal in this example was sent and received at the point shown in FIG. 7 and the carriage has reached a point further in the direction of carriage movement 60 than the carriage position shown in FIG. 7 before stopping. The difference between the position of the carriage 300 in FIG. 7 and FIG. 8 represents a braking distance of the carriage 300 upon actuation of one of the sensors. With reference to FIG. 8, the upstream location of the first sensor assembly 310 with respect to the printheads 353 allows that when a raised portion, such as first raised portion 11, is sensed at the upstream end 354 of the carriage, the raised portion 11 does not contact the printheads 353. The braking distance may be dependent on a speed of movement of the carriage in the carriage movement direction. For example, the braking distance may depend on the maximum speed of the carriage and be configured to allow the carriage to stop before a sensed raised portion can contact the printheads.

Figure 9:
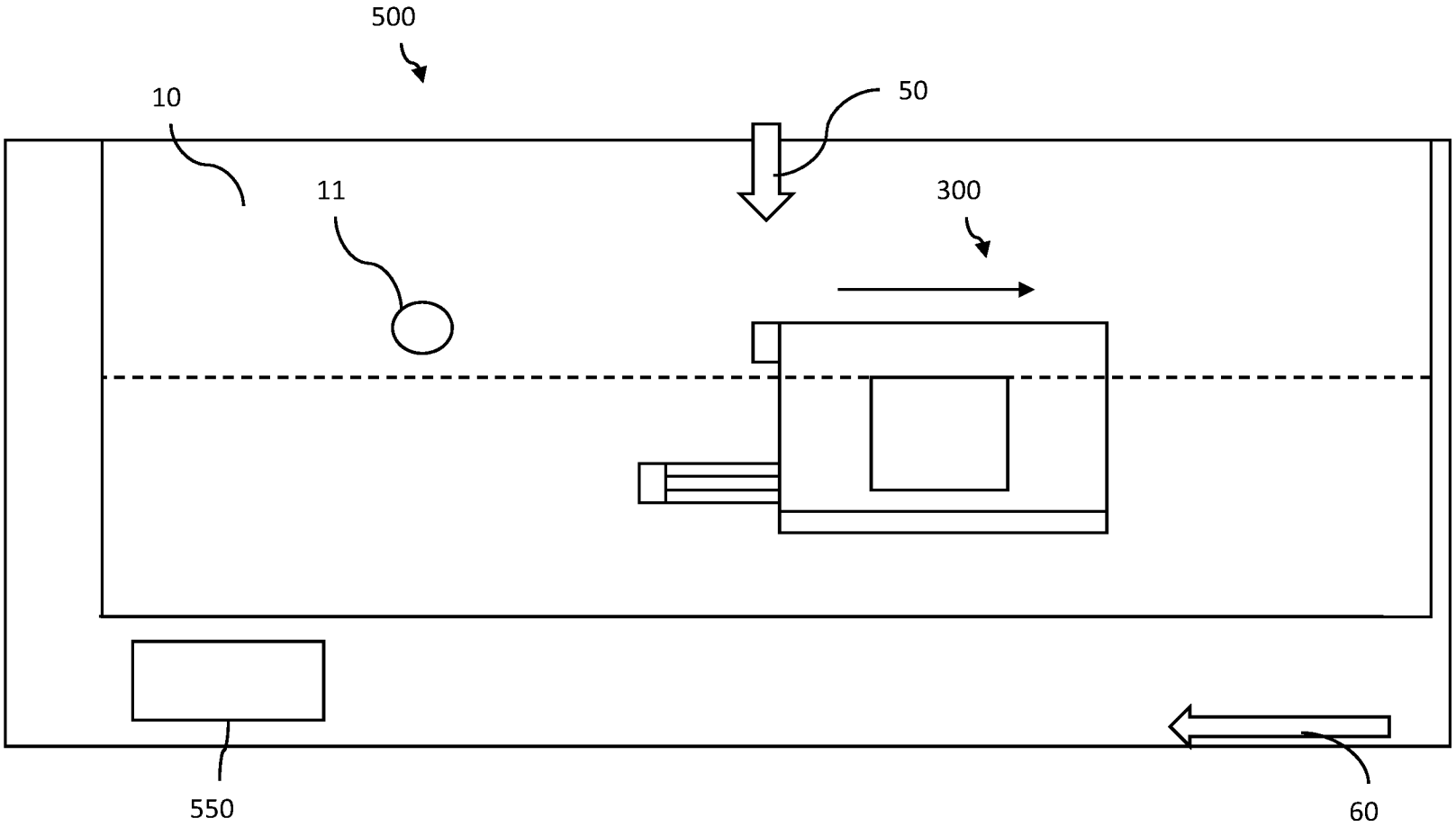
Figure 10:
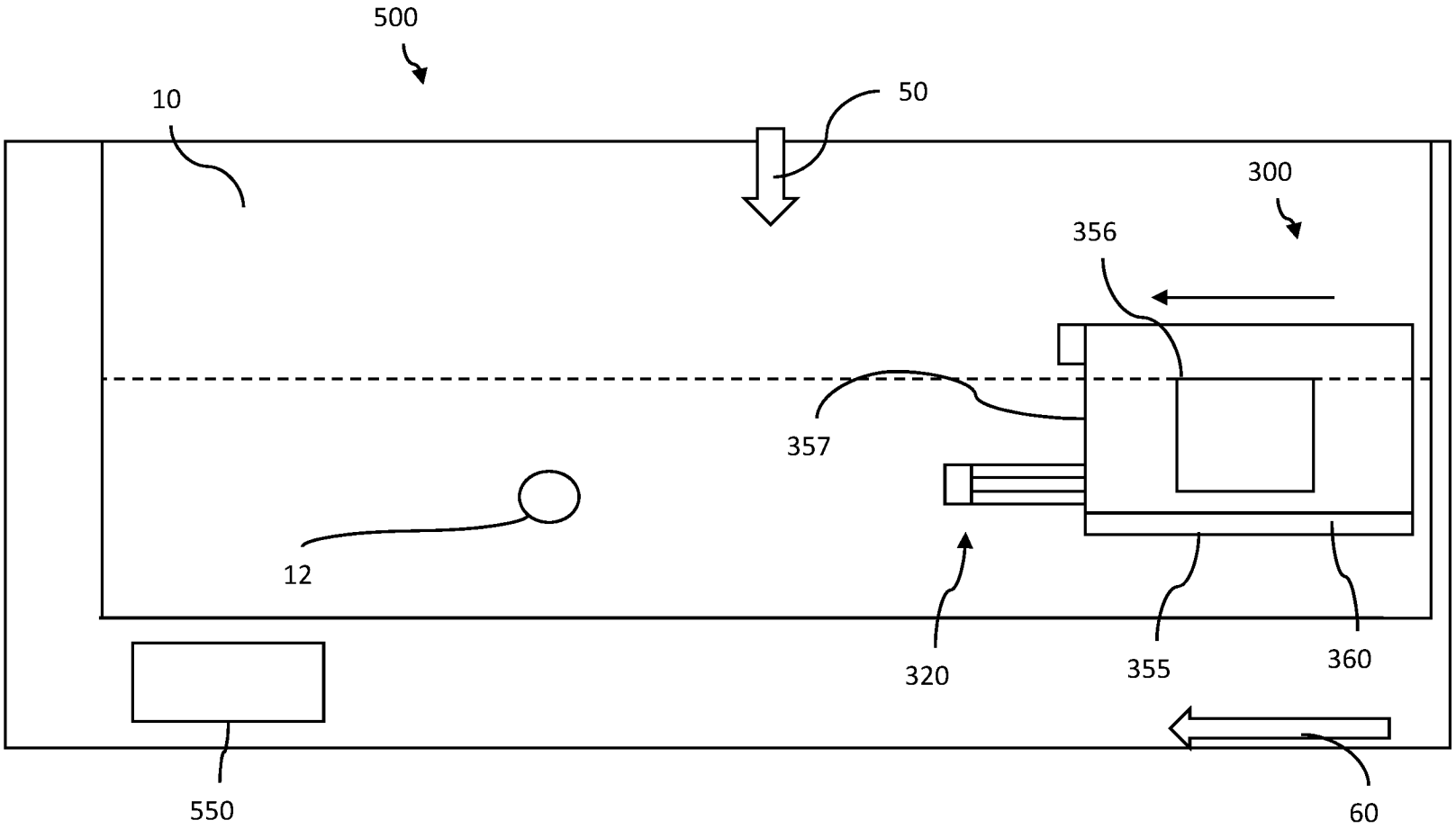

In some examples, the controller 550 may be configured to return the printer carriage 300 to the starting position shown in FIG. 6. FIG. 9 shows the carriage 300 being returned to the starting position after actuation of the first sensor assembly 310. Returning the printer carriage to its starting position may allow a jam caused by the print medium 10, for example the print medium 10 becoming jammed under the print carriage, to be undone. In other examples, the controller 550 may not be configured to return the carriage to a starting position upon actuation of one of the sensors and may be configured to control the carriage in some other way. For example, the controller 550 may be configured to stop the carriage, or, for example, to raise the carriage from the base surface 600 to allow printing media to be removed from under the carriage.

FIG. 10, FIG. 11, FIG. 12 and FIG. 13 show an example where the printing medium 10 comprises a second raised portion 12 which is located downstream of the upstream end 356 of the printheads 353. A raised portion 12 located downstream of the upstream end 356 of printheads 353 may, for example, be caused by the printing process between the printer carriage and the medium 10. In some examples, the printer carriage is configured to apply heat to the medium, for example from a heater located downstream from the printheads. Applying heat to the printing medium 10 may in some instances cause a raised portion, such as second raised portion 12, to be formed which may then present a possibility of a clash between the raised portion 12 and the printer carriage 300. In the examples shown in FIGS. 10 to 13 the printer carriage 300 comprises a heater 360 at a downstream end 355 of the printer carriage 300. The heater 360 may for curing a printing fluid, such as ink, applied to the printing medium 10 as the medium 10 advances in the direction 50.

Figure 11:
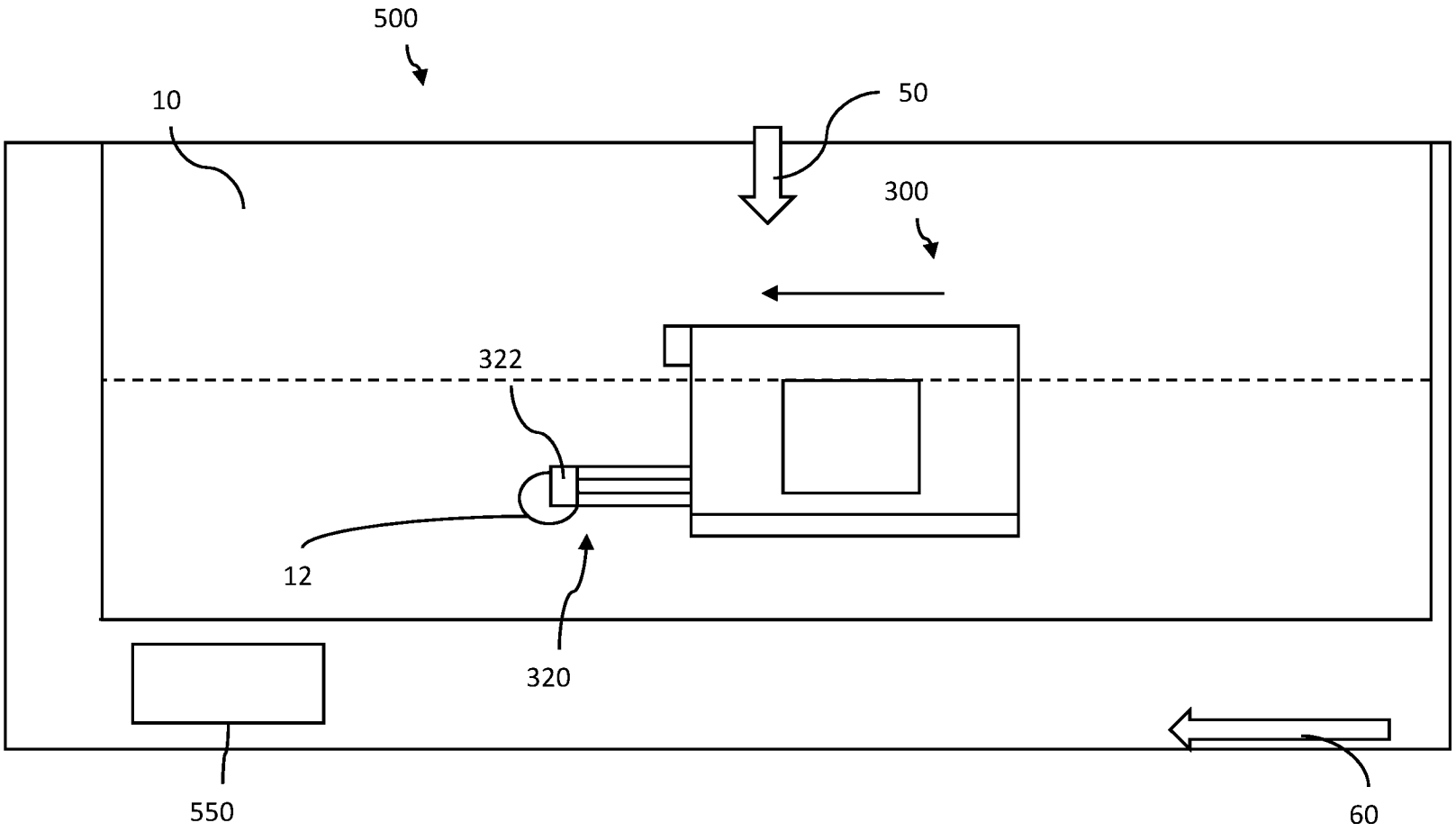

FIG. 11 shows the printer carriage 300 in a position where the carriage has moved towards the second raised portion 12 and the second sensor assembly 320 is in contact with the raised portion 12. The second sensor assembly 320 at the point shown in FIG. 11 sends an actuation signal to the controller 550, and the controller 550 in this example is configured to stop the carriage 300 upon receipt of an actuation signal. In this example, the second raised portion 12 is in a location in the medium advance direction 50 which is equal to a location of a portion of the printheads 353 in the medium advance direction 50. As such, if the carriage 300 were to continue in the carriage movement direction 60 a collision would occur between the carriage and the second raised portion 12 and contact may occur between the second raised portion 12 and the lower surface of the printheads 353.

Figure 12:
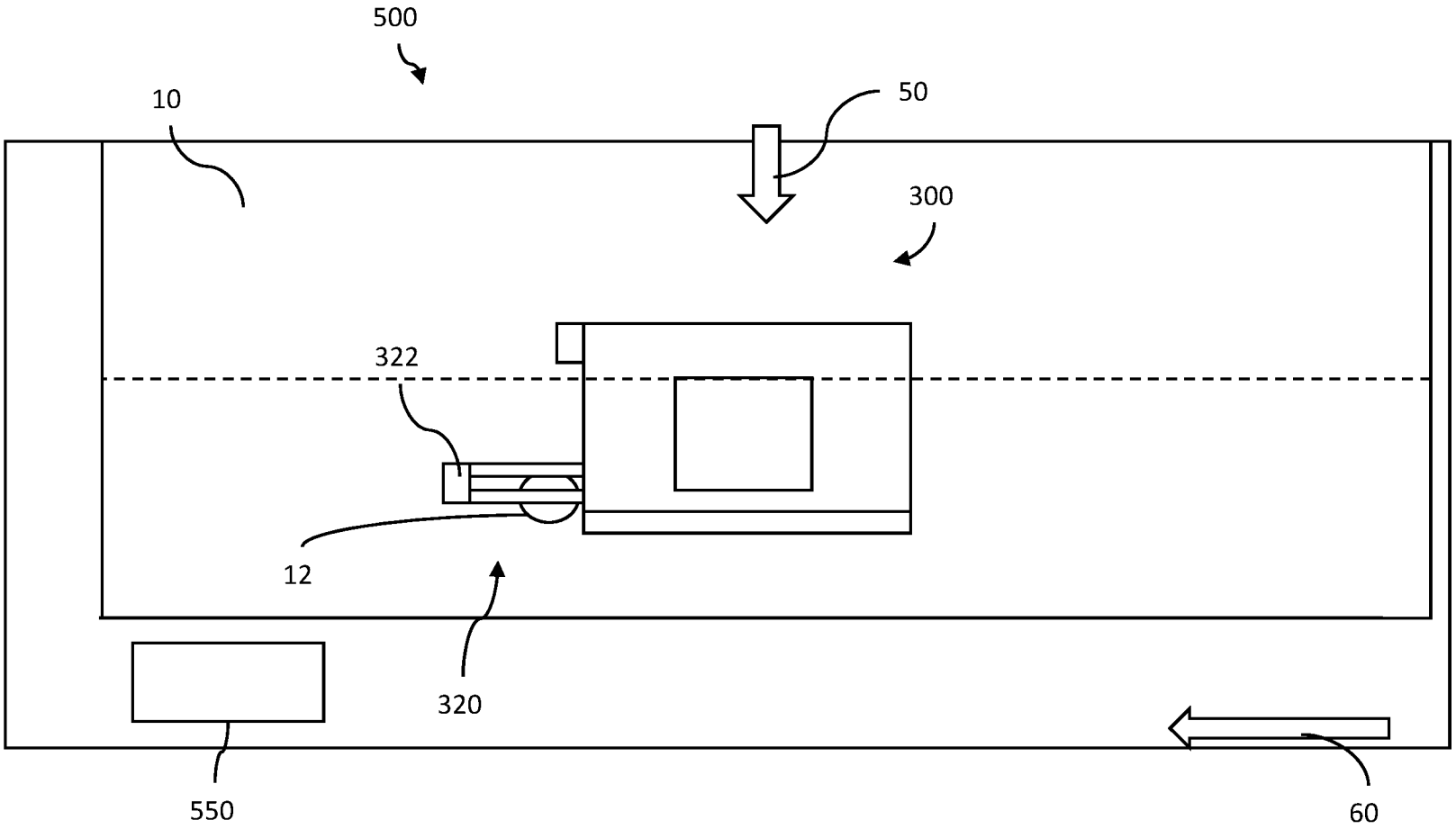

As described with reference to FIG. 7 and FIG. 8, when the carriage 300 is stopped by the controller 550 the carriage 300 moves a braking distance before reaching a stop. FIG. 12 shows the carriage 300 at the point where it has reached a stop. Although the carriage 300 has travelled a distance in the carriage movement direction 60 between actuation of the sensor assembly 320 and the carriage reaching a stop, the second raised portion 12 has not reached the body portion 350 of the printer carriage 300. This is achieved by the second actuation member 312 being spaced from a foremost end 357 of the printer carriage 300 in a direction of movement 60 of the printer carriage 300, providing a braking distance which allows the carriage to stop before the raised portion 12 can contact the printheads 353. The second actuation member 322 is attached in cantilever in some examples to provide the braking distance. In some examples, the spacing of the second actuation member 322 from the foremost edge 357 of the carriage may be greater than the carriage braking distance such that the carriage is able to stop before the raised portion 12 can contact any part of the body portion 350 of the printer carriage. The braking distance may vary depending on a braking system and/or actuators used to move the carriage 300. For example, a longer braking distance may allow a less expensive construction, both in the requirements for the braking system and/or actuators used to move the carriage, but also in the carriage itself which will be subjected to lower braking forces when the braking distance is longer.

In some examples, the printer carriage body portion 350 may comprise a barrier (not shown) which is level with the lowest surface 352 of the printer carriage 300 and in some examples which is level with the lowest surface of the printheads 353; in such examples, the barrier may be located between the foremost edge 357 of the carriage and the foremost edge of the printheads 353 such that the barrier contacts any raised portion which moves under the body portion 150. The barrier may act to depress any raised portion contacted by the body portion 350 and minimise the potential for damage to the printer carriage 300 or to the printing medium 10.

Figure 13:
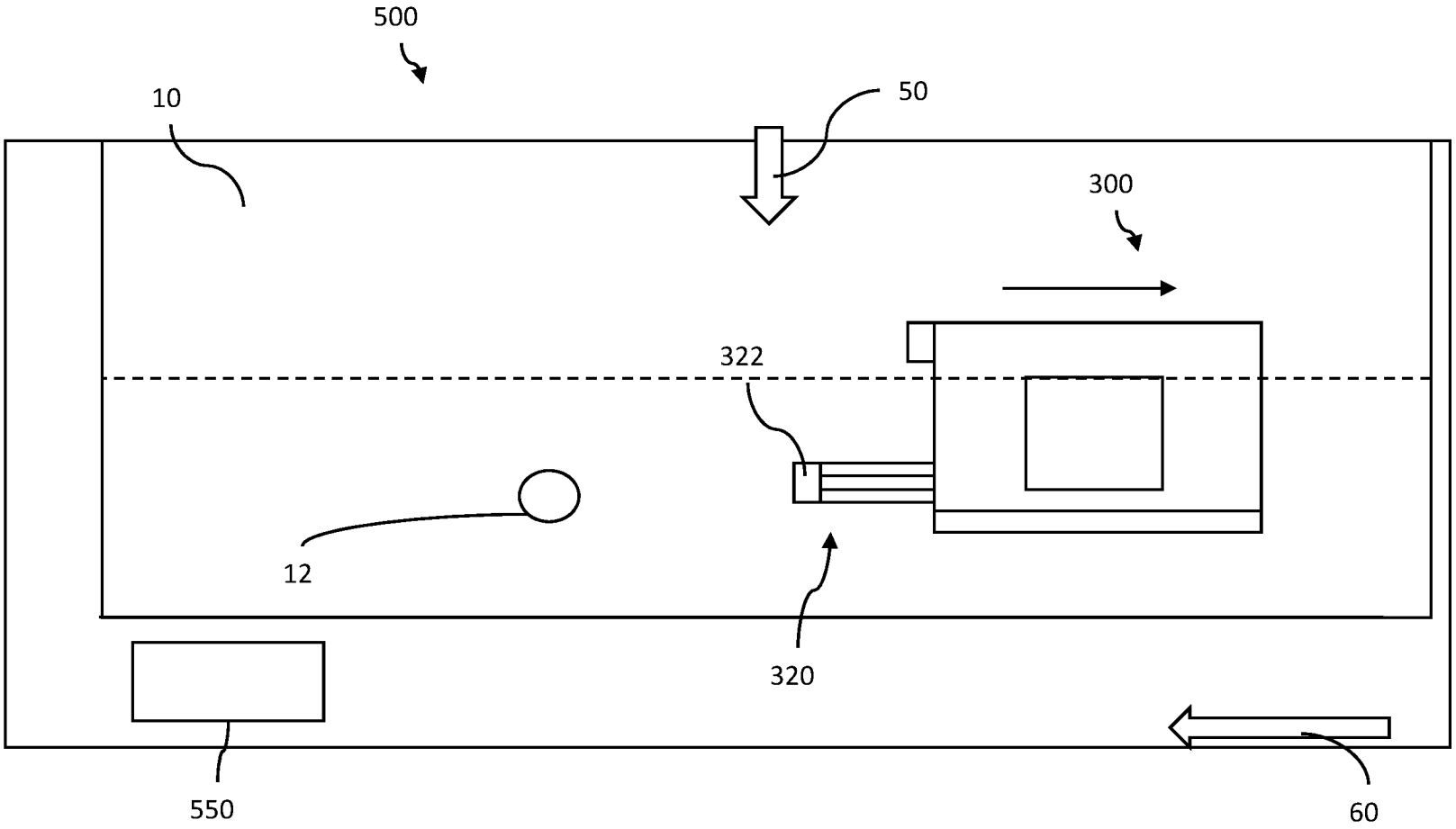

FIG. 13 shows the printing carriage 300 being returned to the starting position of the carriage after the second actuation member 312 has been actuated by the second raised portion 12. The second actuation member 322 is downstream of the printheads 353 and the second raised portion 12 may have been printed on before contacting the second actuation member 322. In such examples the second raised portion 12 may transfer ink or other printing fluid to the actuation member 322. In some examples, the controller 550 may be configured to cause one of or each of the actuation members to be cleaned after an actuation signal is received. For example, the controller 550 may be configured to return the carriage 300 to the starting position and cause a cleaning station, cleaning component or cleaning system (not shown) to clean the actuation member from which an actuation signal was received. For example, the controller may be configured to cause the second actuation member 322 to be cleaned after contact with the second raised portion 12 is sensed. The cleaning station, cleaning component or cleaning system may be used for cleaning of the printheads 353.

In some examples, more than two sensors, for example more than two sensor assemblies, may be provided. For example, a sensor assembly may be provided downstream of the first sensor assembly 310 and may act to detect raised portions which form after a portion of the printing medium 10 has passed under the printheads 353, for example raised portions caused by the application of ink or other printing fluid to the medium 10. Each sensor may be provided at a braking distance from the carriage body portion 350. In other examples, a one sensor or sensor assembly may be located at the rearmost edge of the printer carriage in the direction of movement 60 of the carriage 300. A sensor or sensors placed at the rearmost edge may, for example, sense raised portions caused by the printheads and may determine whether the carriage may be safely moved to the starting position.

In other examples, the second sensor assembly may be attached at a different distance from the foremost edge of the printer carriage or from the rearmost edge of the carriage. For example, the second sensor assembly may be mounted substantially at the foremost edge of the carriage any may be mounted in the same position with respect to the direction of movement of the carriage as the first sensor assembly. In some examples, the second sensor assembly may be mounted substantially at a foremost edge or a rearmost edge of the carriage and the carriage may comprise a braking system (not shown) which allows the carriage to be stopped before contact can be made between the printheads and a raised portion sensed by the second sensor assembly.

The first sensor assembly 310 may comprise any of the features described with reference to the sensor assembly 210 of FIG. 3 and the second sensor assembly 320 may comprise any of the features described with reference to the second sensor assembly 420 of FIG. 4.

The printer 500 may in some examples comprise means for checking for raised portions of the printing medium 10 before the printing carriage 300 or the first sensor assembly 310 is reached by the printing medium 10. For example, the printer 500 may detect via optical means raised portions which protrude higher than the distal end 312*a* of the actuation member 312 or raised portions which extend along the direction of movement 60 of the carriage 300.

The printer carriage in some examples may comprise a different number of sensor assemblies, for example more than two, and each sensor assembly may comprise an actuation member and may comprise a sensor. Each actuation member may be coupled to a sensor and a sensor may have more than one actuation members coupled to it, such that the number of sensors may be less than the number of actuation members. In some examples, the printer carriage may have an actuation member located on each side of the printer carriage with respect to the printer carriage movement direction 60. For example, the printer carriage may comprise one actuation member or two actuation members on a foremost end with respect to the printer carriage movement direction 60 and may comprise one actuation member or two actuation members on a rearmost end with respect to the printer carriage movement direction 60.

While examples discussed herein have been described in terms of a two-dimensional printer printing onto a printing medium, features of the described examples are equally applicable to other types of printer. For example, features described herein may apply to a three-dimensional printer. In some examples, the printing target may be a bed of build material from which a three-dimensional substrate may be constructed.

In examples where movement of a printing medium has been described, the described features may apply to a relative movement of the printing carriage with respect to a printing target.

Although in examples discussed herein a lower surface of the printer carriage is parallel with the printing target, for example the printing medium, in some examples the lower surface of the printing carriage and the printing target may not be parallel. For example, the printing carriage may convey the printheads over the print target at an angle.

Although in examples discussed herein adjustment of the height of the actuation member has been made with respect to the lowest surface of the printer carriage, adjustment of the actuation member height may equally be made with respect to a different element, such as the printheads. In some examples, adjustment of the actuation member height may be made with respect to a position of the print target. In some examples, the vertical direction with which the height of the actuation member is defined may be a direction between a portion of the printing carriage and the print target, for example a direction perpendicular to a surface of the print target.

The preceding description has been presented to illustrate and describe certain examples. Different sets of examples have been described; these may be applied individually or in combination for a synergetic effect. This description is not intended to be exhaustive or to limit these principles to any precise form disclosed. Many modifications and variations are possible in light of the above teaching. It is to be understood that any feature described in relation to any one example may be used alone, or in combination with other features described, and may also be used in combination with any features of any other of the examples, or any combination of any other of the examples.

The invention claimed is:

1. A printer carriage comprising:

a sensor; and an actuation member coupled to the sensor, wherein:

the actuation member is to actuate the sensor when an end of the actuation member contacts a printing target; and a vertical position of the end of the actuation member is adjustable.

2. A printer carriage according to claim 1, wherein the actuation member is to actuate the sensor when the end of the actuation member is rotated by contact with a printing target.

3. A printer carriage according to claim, 2 wherein the actuation member is suspended vertically.

4. A printer carriage according to claim 2, wherein the actuation member is to actuate the sensor when the distal end of the actuation member is rotated by at least 7 degrees.

5. A printer carriage according to claim 1, wherein the distal end of the actuation member comprises a material and a static coefficient of friction between the material and the printing target is at least 0.3.

6. A printer carriage according to claim 1, wherein the sensor and the actuation member are part of an assembly, wherein the assembly is detachable from the printing carriage.

7. A printer carriage according to claim 1, wherein the sensor is a first sensor and the actuation member is a first actuation member, the printer carriage further comprising a second actuation member coupled to a second sensor wherein:

the first actuation arm is mounted towards an upstream end of the carriage in the printing target direction; and the second actuation arm is mounted towards a downstream end of the carriage in the printing target direction; and the second actuation arm is spaced further from the printing carriage in a direction of travel of the printing carriage than the first actuation arm, such that a braking distance is provided between the second actuation arm and the printing carriage.

8. A printer comprising:

a printer carriage according to claim 1; and a reference member, wherein:

the vertical position of the reference member with respect to the printing carriage is adjustable and the reference member is to assist adjustment of the vertical position of the actuation member.

9. A printer comprising:

a printer carriage according to claim 1; and a controller coupled to the sensor to stop the movement of the printer carriage when the sensor is actuated.

10. A printer comprising a printer carriage according to claim 1, wherein the printing target is a printing medium.

11. A printer comprising a printer carriage according to claim 1, wherein the printing target comprises a build surface and the printer is a 3D printer.

12. A printer carriage comprising:

a printhead receiving area;

a first sensor assembly for sensing a raised portion of a printing target; and a second sensor assembly for sensing a raised portion of a printing target, wherein:

the first sensor assembly and the second sensor assembly are mounted on the printing carriage in a position such that they are offset from one another in both the direction of movement of the carriage and the direction of advance of the printing target.

13. A printer carriage according to claim 12, wherein:

the first sensor assembly is located upstream of the printheads in the direction of advance of the printing target;

the second sensor assembly is located downstream of the printheads in the direction of advance of the printing target; and the second sensor assembly is spaced from a foremost end of the printer carriage in a direction of movement of the printer carriage by a distance which allows the printer carriage to stop before any raised portion of the printing target which is sensed by the second sensor assembly can contact the printheads.

14. A printer comprising:

a print carriage according to claim 13; and a controller coupled to the sensor to stop the movement of the print carriage when the first the sensor or the second sensor senses a raised portion of a printing target.

15. A printer comprising:

a print carriage according to claim 12; and a controller coupled to the sensor to stop the movement of the print carriage when the first the sensor or the second sensor senses a raised portion of a printing target.

* * * * *